US009891579B2

(12) United States Patent
Kojima et al.

(10) Patent No.: US 9,891,579 B2
(45) Date of Patent: Feb. 13, 2018

(54) CLEANING MEMBER AND IMAGE FORMING APPARATUS

(71) Applicant: FUJI XEROX CO., LTD., Tokyo (JP)

(72) Inventors: Noriaki Kojima, Kanagawa (JP); Yu Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 117 days.

(21) Appl. No.: 14/719,508

(22) Filed: May 22, 2015

(65) Prior Publication Data

US 2016/0147192 A1 May 26, 2016

(30) Foreign Application Priority Data

Nov. 20, 2014 (JP) ..... 2014-235385

(51) Int. Cl.
*G03G 21/00* (2006.01)

(52) U.S. Cl.
CPC ..... *G03G 21/0017* (2013.01)

(58) Field of Classification Search
USPC ..... 399/34, 123
See application file for complete search history.

(56) References Cited

U.S. PATENT DOCUMENTS

| | | | | |
|---|---|---|---|---|
| 7,711,307 | B2 | 5/2010 | Kageyama | |
| 8,275,302 | B2 * | 9/2012 | Sako | B29C 39/025 399/273 |
| 2013/0251401 | A1 | 9/2013 | Asano et al. | |

FOREIGN PATENT DOCUMENTS

| | | | |
|---|---|---|---|
| JP | 9-96996 | A | 4/1997 |
| JP | 2007-148036 | A | 6/2007 |
| JP | 2008-51901 | A | 3/2008 |
| JP | 2013-214037 | A | 10/2013 |

OTHER PUBLICATIONS

"Thermoplastic Polyurethane Elastomer Kuramiron", Kuraray.*

* cited by examiner

*Primary Examiner* — Minh Phan
(74) *Attorney, Agent, or Firm* — Sughrue Mion, PLLC

(57) ABSTRACT

A cleaning member includes a base member comprised of a first material that has a peak temperature of tan δ less than approximately zero degrees Celsius and a contact portion comprised of a second material that has a higher hardness than the first material and a tear strength of approximately 49 kilonewtons per meter or higher, the contact portion contacting an image carrier and cleaning the image carrier.

8 Claims, 6 Drawing Sheets

CLEANING MEMBER AND IMAGE FORMING APPARATUS

CROSS-REFERENCE TO RELATED APPLICATIONS

This application is based on and claims priority under 35 USC 119 from Japanese Patent Application No. 2014-235385 filed Nov. 20, 2014.

BACKGROUND

Technical Field

The present invention relates to cleaning members and image forming apparatuses.

SUMMARY

A cleaning member according to an aspect of the invention includes a base member comprised of a first material that has a peak temperature of tan δ less than approximately zero degrees Celsius; and a contact portion comprised of a second material that has a higher hardness than the first material and a tear strength of approximately 49 kilonewtons per meter or higher, the contact portion contacting an image carrier and cleaning the image carrier.

BRIEF DESCRIPTION OF THE DRAWINGS

Exemplary embodiments of the present invention will be described in detail based on the following figures, wherein.

DETAILED DESCRIPTION

Figure 1:
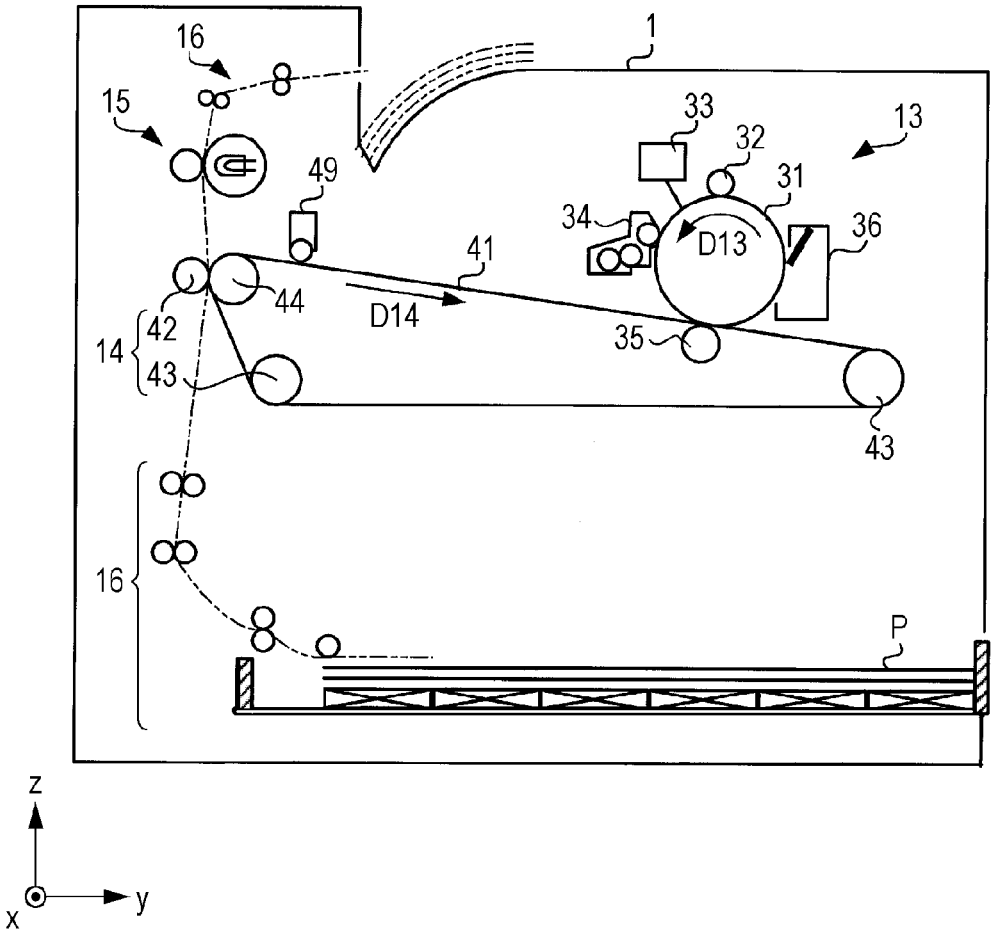
FIG. 1 illustrates the entire configuration of an image forming apparatus according to an exemplary embodiment of the invention.

1. Exemplary Embodiment 1-1. Entire Configuration of Image Forming Apparatus

The configuration of an image forming apparatus 1 according to an exemplary embodiment of the invention is described below. In the drawings, the space in which components of the image forming apparatus 1 are disposed is represented as a xyz right-handed coordinate system space. Among the coordinate symbols illustrated in the drawings, an encircled dot denotes an arrow directing from the back to the front of the sheet. In the space, the direction along the x axis is represented as an x-axis direction. Part of the x-axis direction in which the x component increases is represented as a +x direction, whereas part of the x-axis direction in which the x component decreases is represented as a −x direction. Similarly, a y-axis direction, a +y direction, a −y direction, a z-axis direction, a +z direction, and a −z direction represent the directions defined in accordance with the above definition relating to the y or z component.

FIG. 1 illustrates the entire configuration of the image forming apparatus 1 according to an exemplary embodiment of the invention. As illustrated in FIG. 1, the image forming apparatus 1 includes a developing portion 13, a transfer portion 14, a fixing portion 15, and a transporting portion 16.

The transporting portion 16 includes a container and transport rollers. The container holds paper sheets P serving as media. The paper sheets P contained in the container are picked up one by one by a transport roller in response to a command from a controller, not illustrated, and transported to the transfer portion 14 through a sheet transport path. The media are not limited to paper sheets and may be sheets comprised of, for example, resin. In short, any media that is capable of recording images on their surfaces may be used.

The developing portion 13 includes an image carrier 31, a charging device 32, an exposing device 33, a developing device 34, a first transfer roller 35, and a drum cleaner 36. The image carrier 31 is a photoconductor drum having an electric-charge generating layer and an electric-charge conveying layer. The image carrier 31 is rotated by a driving portion, not illustrated, in the direction of an arrow D13 around the axis extending in the x-axis direction of FIG. 1. The charging device 32 charges the surface of the image carrier 31. The exposing device 33 includes components such as a laser-beam emitting source and a polygon mirror, not illustrated. The exposing device 33 irradiates the image carrier 31 charged by the charging device 32 with a laser beam in accordance with an image data under the control of a controller, not illustrated. Thus, a latent image is held on the image carrier 31.

The above-described image data may be the one that the image forming apparatus 1 receives from an external apparatus via a communicating portion, not illustrated. Examples of the external apparatus here include a reading device that reads an original image or a storage device that stores data representing an image. The developing device 34 supplies a developer to the image carrier 31. Thus, an image is formed (developed) on the image carrier 31.

The first transfer roller 35 causes a predetermined potential difference at a position at which an intermediate transfer belt 41 of the transfer portion 14 faces the image carrier 31. Thus, the first transfer roller 35 transfers the image to the intermediate transfer belt 41 using the potential difference. The drum cleaner 36 removes toner remaining on the surface of the image carrier 31 without being transferred after the image has been transferred and eliminates static from the surface of the image carrier 31.

The transfer portion 14 includes an intermediate transfer belt 41, a second transfer roller 42, belt transport rollers 43, a backup roller 44, and a belt cleaner 49. The transfer portion 14 transfers an image formed by the developing portion 13 to a paper sheet P. The belt transport rollers 43 and the backup roller 44 are disposed so as to be rotatable around respective axes extending in the x-axis direction of FIG. 1. The intermediate transfer belt 41 is an endless belt member and is stretched around the belt transport rollers 43 and the backup roller 44.

At least one of the belt transport rollers 43 and the backup roller 44 includes a driving portion (not illustrated) to move the intermediate transfer belt 41 in the direction of an arrow D14 of FIG. 1. The remaining roller or rollers 43 and/or 44 that do/does not include a driving portion are/is rotated in accordance with the movement of the intermediate transfer belt 41. Rotating the intermediate transfer belt 41 in the direction of the arrow D14 of FIG. 1 moves the image on the intermediate transfer belt 41 to a position at which the image is nipped between the second transfer roller 42 and the backup roller 44.

The second transfer roller 42 transfers the image on the intermediate transfer belt 41 to a paper sheet P transported from the transporting portion 16 using the potential difference between the second transfer roller 42 and the intermediate transfer belt 41. A belt cleaner 49 removes toner remaining on the surface of the intermediate transfer belt 41 without being transferred. The transfer portion 14 or the transporting portion 16 transports to the fixing portion 15 the paper sheet P to which the image has been transferred. The fixing portion 15 fixes to the paper sheet P by heating the image that has been transferred to the paper sheet P.

1-2. Configuration of Drum Cleaner

Figure 2:
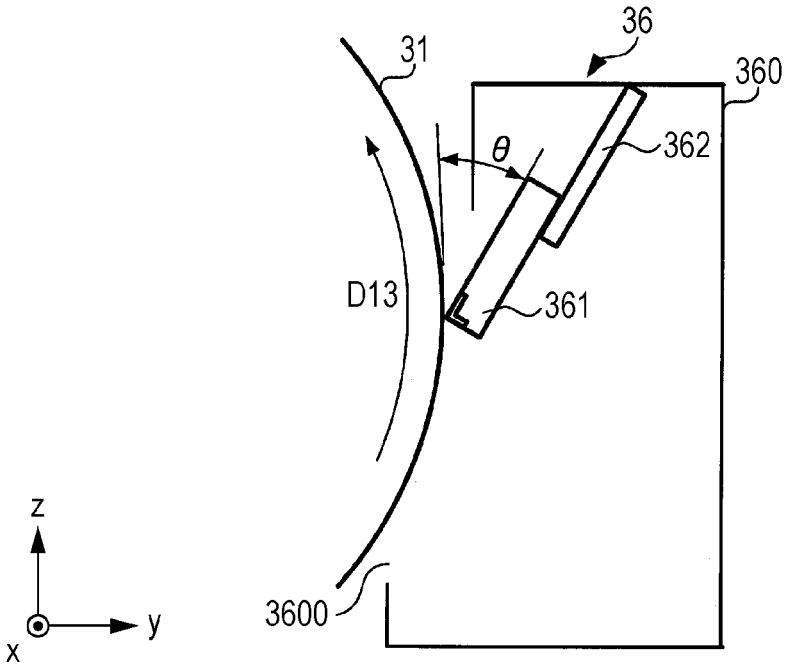
FIG. 2 illustrates the configuration of a drum cleaner.

FIG. 2 illustrates the configuration of the drum cleaner 36. As illustrated in FIG. 2, the drum cleaner 36 includes a casing 360, a plate member 361, and a support member 362. The drum cleaner 36 may also include components such as a mechanism that eliminates static from the surface of the image carrier 31 and a mechanism that supplies a lubricant to the surface.

The casing 360 is a housing that includes a support member 362 and has an opening 3600 on the side facing the image carrier 31. The support member 362 has one end fixed to the inside of the casing 360. The other end of the support member 362 is a free end and supports one end of the plate member 361. The other end of the plate member 361 is exposed through the opening 3600 of the casing 360. The plate member 361 supported by the support member 362 is in contact with the image carrier 31 at a predetermined pressure and at a predetermined angle (hereinafter referred to as a contact angle θ). The support member 362 does not have to support the plate member 361 throughout the full length in the x-axis direction.

Figure 3:
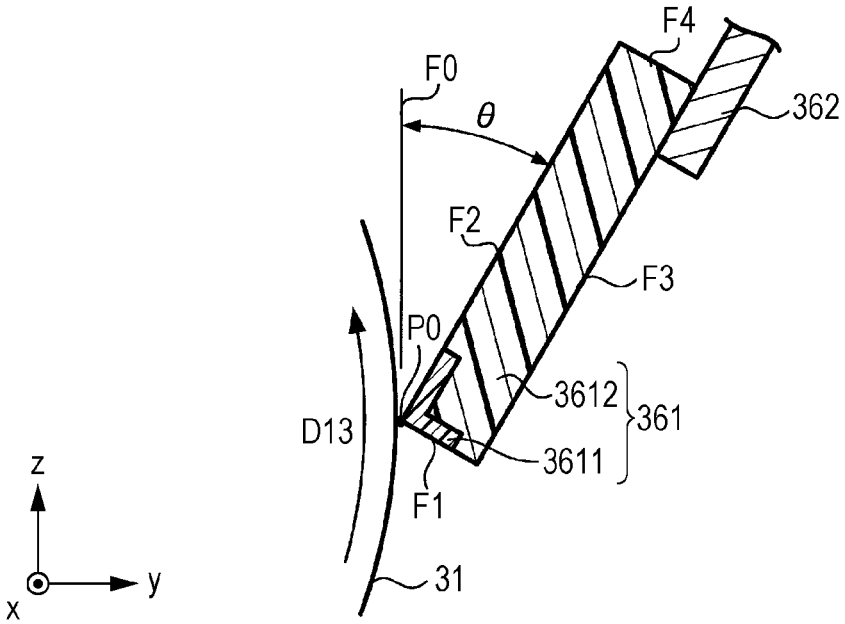
FIG. 3 illustrates the structure of a plate member.

FIG. 3 illustrates the structure of the plate member 361. The point at which the plate member 361 comes into contact with the image carrier 31 is a contact point P0. The contact point P0 may be any point on the surface of the image carrier 31. Here, the contact point P0 is regarded as a point furthest in the +y direction. The contact angle θ is an angle formed between the tangent plane F0 at the contact point P0 of the image carrier 31 and a direction in which the plate member 361 extends. The contact angle θ is an acute angle, that is, an angle less than a right angle.

The plate member 361 is an example of a cleaning member according to an exemplary embodiment of the invention. The plate member 361 is a plate-shaped cleaning blade and includes a contact portion 3611 and a base member 3612.

The base member 3612 is a member comprised of, for example, rubber. The base member 3612 includes a portion that is attached or bonded to the support member 362. Since this portion of the base member 3612 is attached or bonded to the support member 362, the plate member 361 is supported in a fixed position at a predetermined position in the casing 360. The material of the base member 3612 is hereinafter referred to as a first material. The first material is not limited to rubber and may be any material that satisfies the conditions described below.

The contact portion 3611 is a portion of the plate member 361 that comes into contact with the contact point P0 of the image carrier 31 and is comprised of a second material having a hardness higher than that of the first material. Specifically, the contact portion 3611 is formed by changing the quality of part of an original base member, which has the shape of the plate member 361, on the surface or surfaces facing the image carrier 31. In this case, the base member 3612 is a remaining portion of the original base member whose quality has not been changed in the quality change. The quality change is a process during which the hardness of the first material forming the base member 3612 is enhanced to form a second material. Examples of the quality change include various types of oxidation treatment such as ultraviolet irradiation, corona discharge, plasma emission, or ozone atmosphere exposure and isocyanate resin impregnation.

The contact portion 3611 may be formed by coating the base member 3612 with any of various types of resin, low frictional agents, and particles. However, desirably, the contact portion 3611 is formed by changing the quality of the first material into the second material on the surface of the base member 3612. This is because the contact portion 3611 formed by quality change is generally less likely to be detached at the boundary between itself and the base member 3612 than in the case of a contact portion formed through coating.

The contact portion 3611 removes an object such as toner adhering to the surface of the image carrier 31 by coming into contact with the image carrier 31 at the contact point P0. The object that has been scraped off by the contact portion 3611 of the plate member 361 is held in the casing 360 and removed from the image forming apparatus 1 at the time of maintenance. Specifically, the contact portion 3611 is comprised of a second material having a hardness higher than that of the first material. The contact portion 3611 is an example of a contact portion that cleans the image carrier by coming into contact with the image carrier in motion.

The contact portion 3611 may have any shape as long as it extends to a contact point P0. FIGS. 4A to 4D illustrate examples of the shape of the contact portion 3611 of the plate member 361. Among the surfaces of the plate member 361, one that faces the image carrier 31 and in the −z direction is referred to as a surface F1 whereas one that faces the image carrier 31 and in the +z direction is referred to as a surface F2. Among the surfaces of the plate member 361, one that faces away from the image carrier 31 and in the −z direction is referred to as a surface F3 whereas one that faces away from the image carrier 31 and in the +z direction is referred to as a surface F4.

Figure 4A:
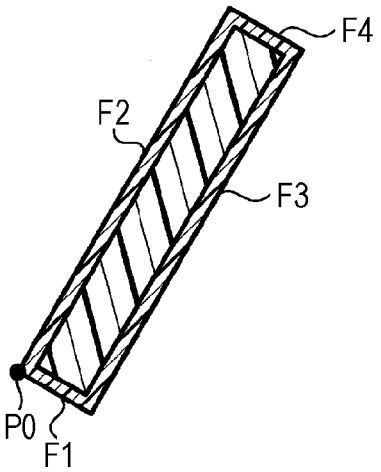
FIGS. 4A to 4D illustrate examples of the shape of a contact portion of the plate member.
Figure 4B:
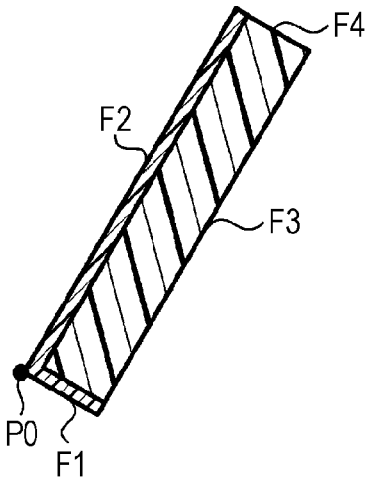
Figure 4C:
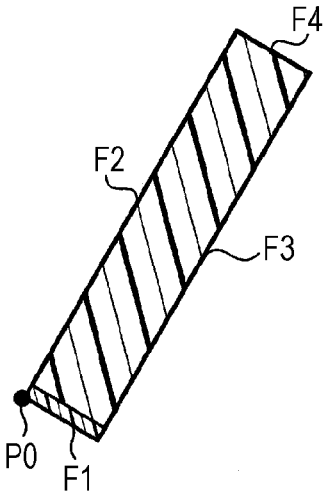
Figure 4D:
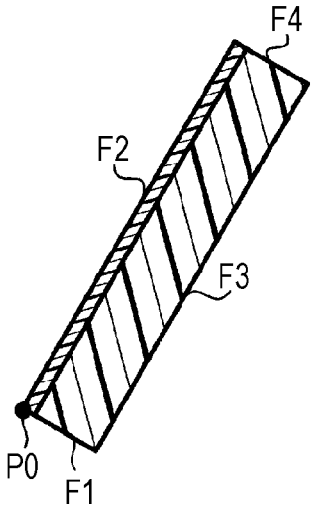

The contact portion 3611 may be disposed so as to extend over all the surfaces F1 to F4, as illustrated in FIG. 4A, or may be disposed so as to extend over the entireties of the surfaces F1 and F2 facing the image carrier 31, as illustrated in FIG. 4B. Alternatively, the contact portion 3611 may be disposed so as to extend over only the entirety of the surface F1, as illustrated in FIG. 4C, or may be disposed so as to extend over only the entirety of the surface F2, as illustrated in FIG. 4D.

2. Results of Experiment

Figure 5:
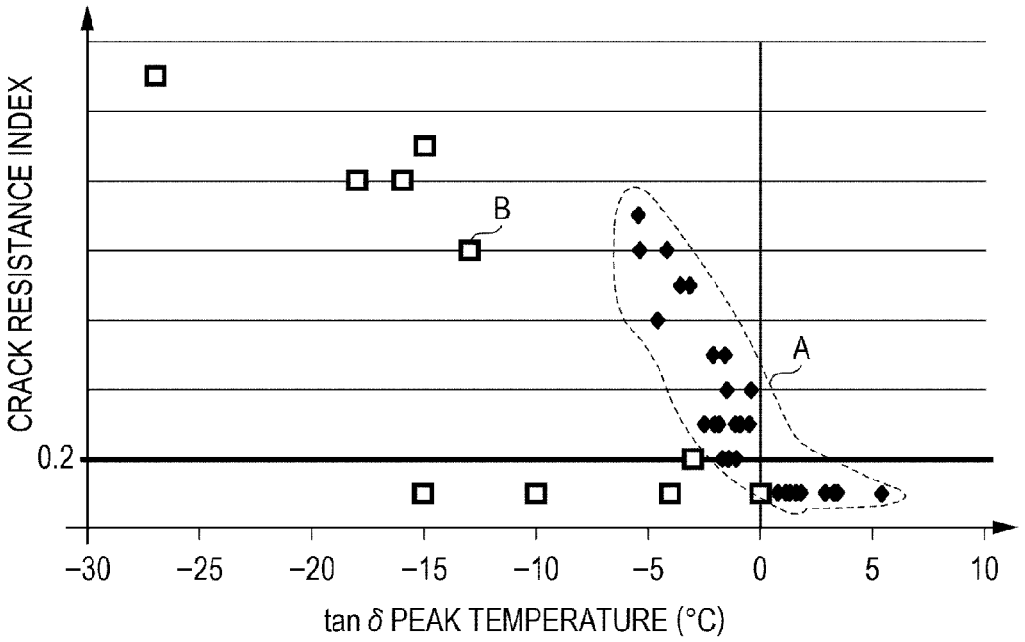
FIG. 5 is a graph of the crack resistance index of the contact portion with respect to the peak temperature of tan δ of a first material, represented with different symbols corresponding to types of a second material.

FIG. 5 is a graph of the crack resistance index of the contact portion 3611 with respect to the peak temperature (referred to as "tan δ peak temperature") of tan δ of the first material forming the base member 3612, represented with different symbols corresponding to types of the second material forming the contact portion 3611. Types of the second material are sorted into a A based material and a B based material by the original materials of the first material. What kind of effect is exerted on the crack resistance index was checked as a result of variously changing the conditions (factors such as process duration or liquid concentration) under which the quality change is performed on the first material. During measurement of the crack resistance index, the thickness of the contact portion 3611 was determined as 0.05 millimeters. This thickness is a thickness determined by a dynamic ultramicro hardness tester, described below.

The tan δ peak temperature is a temperature falling within the glass transition range of a certain material at which tan δ is maximum. The "δ" of tan δ denotes a loss angle.

Specifically, the tan δ peak temperature of a material was measured using an automatic dynamic viscoelastometer RHEOVIBRON (manufactured by Orientec Co., Ltd.), at the frequency of 10 Hz while the temperature is increased 0.1° C./min from the lower side (−45° C.) to the higher side (35° C.).

Tan δ at each temperature was obtained by the following method. Both end portions of each test piece were fixed to the viscoelastometer. A predetermined tension was applied to the test piece, the test piece was strained at the frequency of 10 Hz, and the stress thus caused in the test piece was measured. This stress was decomposed into an elastic stress based on which the storage elastic modulus and the loss elastic modulus were calculated. Tan δ was obtained by dividing the loss elastic modulus by the storage elastic modulus. The highest temperature of the obtained tan δ at each temperature was designated as the tan δ peak temperature.

The crack resistance index is an index that represents how easily the cleaning member, which cleans the image carrier, is likely to crack as a result of coming into contact with the image carrier in motion. The crack resistance index was measured in the following method.

The plate member 361 was mounted on DocuCentre-IVC5575 manufactured by Fuji Xerox Corporation, the contact pressure was adjusted to 2.0 gf/mm, the contact angle was adjusted to 11°, and the measurement was performed under the temperature of 10° C. and the relative humidity of 15%. Conical protrusions were provided on the surface of the image carrier 31. Every time after the image carrier 31 makes 25 rotations, the blade end, that is, the portion of the contact portion 3611 that comes into contact with the image carrier 31 was observed. The number of rotations after which a crack was observed was determined as a cracking cycle number. The value obtained by dividing the obtained cracking cycle number by 250 was determined as a crack resistance index.

Sapphire was used as the material of the protrusions. The angle at the end of the protrusions was 60 degrees, the radius of curvature was 0.05 millimeters, and the height was 0.05 millimeters.

For example, if the contact portion 3611 is found to be cracked after the image carrier 31 has made first 25 rotations, the cracking cycle number is represented as "25" and the crack resistance index is represented as "0.1". The sample having a crack resistance index of 0.2 or higher is regarded as being practically tolerable and the sample having a crack resistance index of 0.1 or lower is regarded as being practically unacceptable.

As illustrated in FIG. 5, when the tan δ peak temperature is used alone as an index, the conditions under which the crack resistance index is 0.2 or higher are not found regardless of the type of the second material. This is probably because, although the same material is used, the difference in conditions between the ways of the quality change changes the crack resistance of a finally obtained contact portion 3611.

Figure 6:
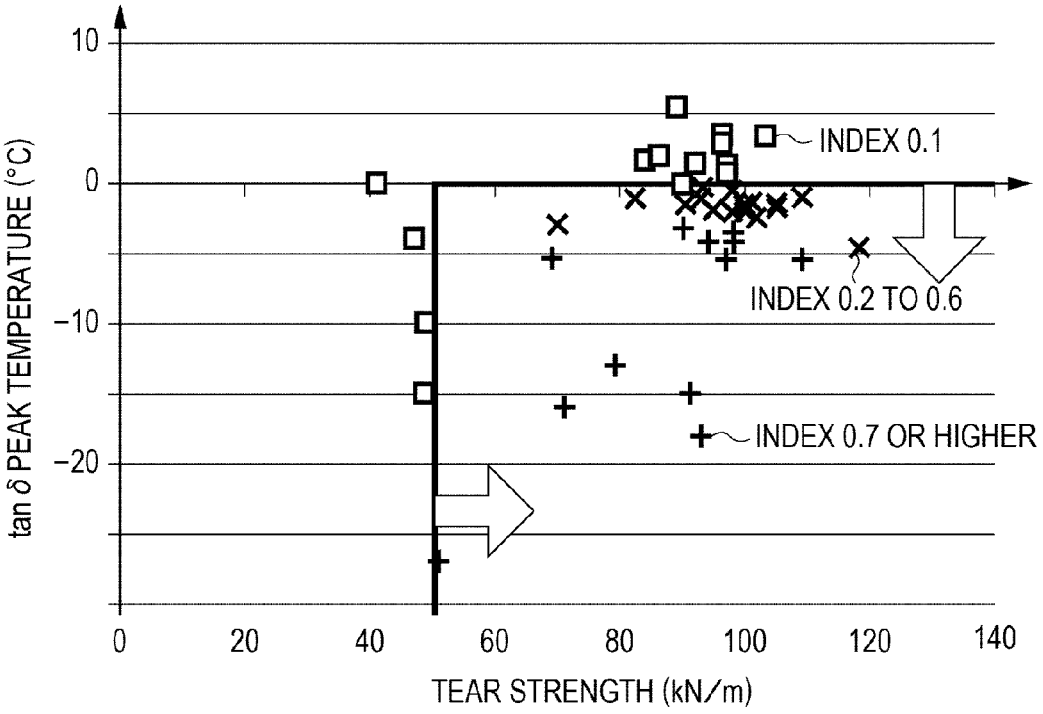
FIG. 6 is a graph of the peak temperature of tan δ of the first material with respect to the tear strength of the second material, represented with different symbols sorted by the crack resistance index.

FIG. 6 is a graph of the tan δ peak temperature of the first material with respect to the tear strength of the second material, represented with different symbols sorted by the crack resistance index. The samples are sorted into three groups, a group having a crack resistance index of 0.1, a group having a crack resistance index within the range of 0.2 to 0.6, and a group having a crack resistance index of 0.7 or higher. The samples in each group were denoted by the same symbols.

The tear strength (kilonewton per meter [kN/m]) was measured in accordance with JIS-K6252 "Rubber, Vulcanized or Thermoplastic, Determination of Tear Strength" while the rate at which a test-piece gripper moves is determined at 500±50 millimeters per minute [mm/min], an uncut angle test piece was stretched, and the maximum tear strength at which the test piece is broken was read. The tear strength TR was obtained from the following equation (1):

$$TR=F/t \quad (1).$$

Here, F (newton [N]) is the maximum tear strength described above and t (millimeters [mm]) is the thickness of the test piece. Strograph AE elastomer manufactured by Toyo Seiki Seisaku-sho, Ltd. was used as a testing machine.

As illustrated in FIG. 6, it is found that the crack resistance index of the contact portion 3611 is 0.2 or greater when the tan δ peak temperature of the first material is less than 0 degrees Celsius and the tear strength of the second material is 49 kilonewtons per meter or higher.

Thus, a cleaning member that is less likely to crack is produced by selecting the material and the conditions (factors such as process time and liquid concentration) of the quality change at the design stage of the plate member 361, serving as a cleaning member, in such a manner that the peak temperature of tan δ of the first material forming the base member 3612 is determined to be less than 0 degrees Celsius and the tear strength of the second material forming the contact portion 3611 is 49 kilonewtons per meter or higher.

3. Modified Example

An exemplary embodiment has been described thus far, but the contents of the exemplary embodiment may be modified in the following manner. Modified examples may be combined together.

3-1. Modified Example 1

In the above-described exemplary embodiment, the image forming apparatus 1 includes only one developing portion 13 but may include multiple developing portions 13. In this case, the image forming apparatus 1 may include, in one-to-one correspondence with the multiple developing portions 13, image carriers 31, charging devices 32, exposing devices 33, developing devices 34, first transfer rollers 35, and drum cleaners 36. The multiple developing portions 13 may form toner images of different colors. In this case, the toner images of different colors are transferred to the intermediate transfer belt 41 in a stacked manner, so that a color image is formed on a medium such as a paper sheet P.

3-2. Modified Example 2

In the above-described exemplary embodiment, the plate member 361 is included in the drum cleaner 36, but may be included in the belt cleaner 49. In this case, the plate member 361 may remove an object adhering to the intermediate transfer belt 41 instead of the image carrier 31. Here, the image carrier 31 and the intermediate transfer belt 41 are examples of an image carrier that holds an image that is to be formed on a medium.

3-3. Modified Example 3

Figure 7:
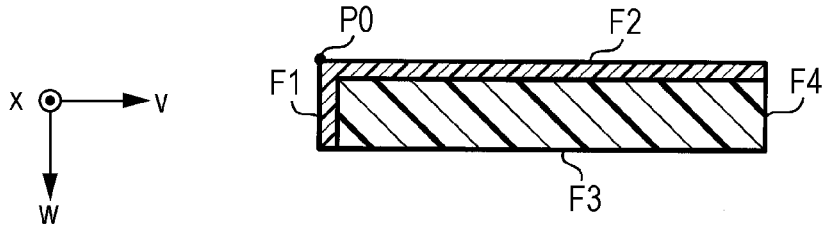
FIG. 7 illustrates the thickness of the contact portion.

Desirably, the thickness of the contact portion 3611 is 0.1 millimeters or less. FIG. 7 illustrates the thickness of the contact portion 3611. As illustrated in FIG. 4B, for example, the contact portion 3611 extends over the entireties of the surfaces F1 and F2 from the contact point P0. The direction of the depth in the surface F1 is defined as a +v direction and the direction of the depth in the surface F2 is defined as a +w direction. The contact point P0 is a ridge extending in the x-axis direction of the plate member 361. Thus, this space is represented by the x axis, the v axis, and the w axis.

Figure 8:
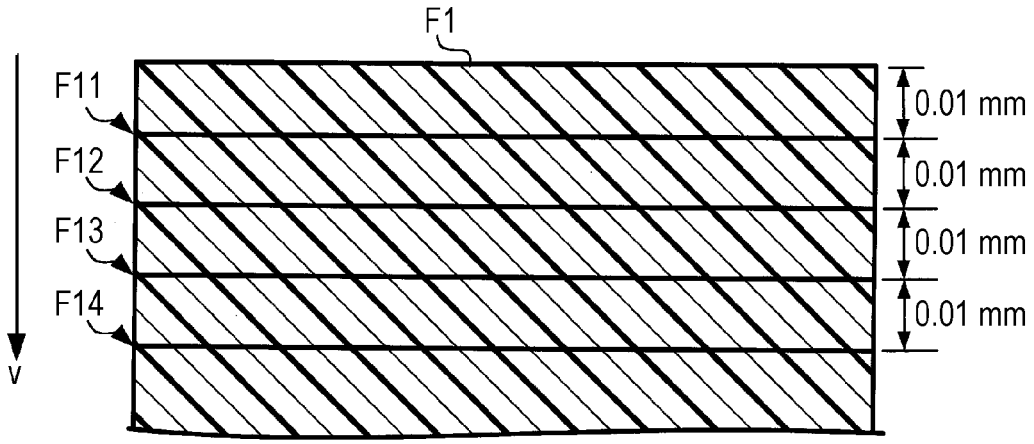
FIG. 8 illustrates the contact portion in a manner enlarged in the direction of the thickness from the surface.

FIG. 8 illustrates the contact portion 3611 in a manner enlarged in the direction of the thickness from the surface F1. The +v direction, which is the direction of the thickness from the surface F1, is a direction along the normal to the surface F1.

Using a dynamic ultramicro hardness tester DUH-W201S manufactured by Shimadzu Corporation, the dynamic ultramicro hardness DH of the contact portion 3611 was measured at each section formed by being scraped per 0.01 millimeters from the surface F1. The portion that has a dynamic ultramicro hardness DH 30% less than that of the previously measured portion, that is, the portion that is 0.01 millimeters shallower is determined as being no longer the contact portion 3611.

For example, in FIG. 8, measured portions F11, F12, F13, and F14 are sections respectively positioned at the depth of 0.01, 0.02, 0.03, and 0.04 millimeters from the surface F1 in the v direction. Here, if the dynamic ultramicro hardness DH measured at the measured portion F14 is 30% less than the dynamic ultramicro hardness DH measured at the measured portion F13, the thickness of the contact portion 3611 ends at the measured portion F13.

The dynamic ultramicro hardness DH is a hardness calculated from the following equation (2) using the indent depth D micrometers [μm] at the time when a diamond triangular pyramid indenter (inter-ridge angle of 115 degrees and α of 3.8584) is indented at the pressing speed of 0.047399 millinewtons per second [mN/s], at the testing load P=4.0 millinewtons [mN], and under the environmental temperature of 23° C.:

$$DH=\alpha\times P/D2 \quad (2),$$

where α denotes a constant relating to the shape of the indenter.

Figure 9:
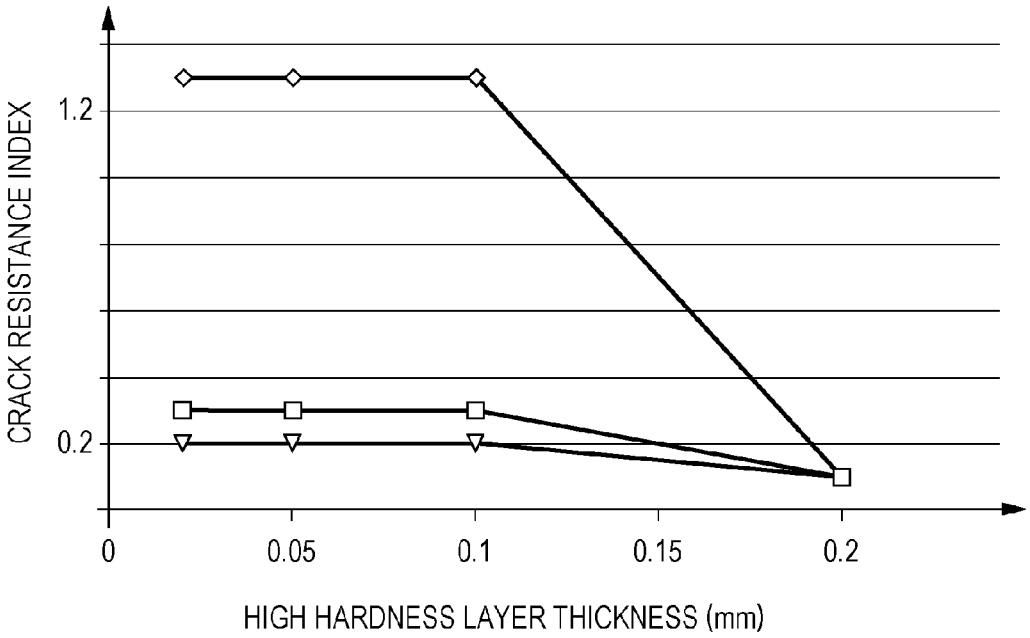
FIG. 9 is a graph of the crack resistance index with respect to the thickness of the contact portion.

FIG. 9 is a graph of the crack resistance index with respect to the thickness of the contact portion 3611 assessed by the dynamic ultramicro hardness. The experiment was performed on three types of second material and in which the crack resistance index was measured while the thickness of the contact portion 3611 was changed in four stages of 0.02, 0.05, 0.1, and 0.2 millimeters. The selected three types of second material are those respectively having crack resistance indexes of 0.2, 0.3, and 1.3 (all of which are 0.2 or higher, regarded as being "practically bearable") when the thickness of the contact portion 3611 is 0.05 millimeters.

As illustrated in FIG. 9, at the thickness of 0.1 millimeters, all the types of material have maintained the same crack resistance indexes as those at the thickness of 0.05 millimeters. However, at the thickness of 0.2 millimeters, all the types of material have reduced their crack resistance indexes to 0.1. Specifically, it is desirable that the thickness of the contact portion 3611 be 0.1 millimeters or less. The material having a thickness of 0.2 millimeters or greater is found to be practically unacceptable in terms of the crack resistance index.

The depth by which the material wears as a result of a contact with the image carrier is approximately several tens of micrometer at most. Thus, wear negligibly affects the material even when the thickness of the contact portion 3611 is 0.1 millimeters or less. The +w direction, which is the direction of the thickness from the surface F2 is also defined similarly to the case of the v direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member, comprising:

a base member comprised of a first material that has a peak temperature of tan δ less than approximately zero degrees Celsius; and a contact portion comprised of a second material that has a higher hardness than the first material and a tear strength of approximately 49 kilonewtons per meter or higher, the contact portion being configured to contact an image carrier and being configured to clean the image carrier, wherein a surface modification has been performed on a surface of the base member to change the first material into the second material; and wherein the surface modification comprises changing a quality of the first material to form the second material.

2. The cleaning member according to claim 1, wherein the contact portion has a thickness of approximately 0.1 millimeters or less.

3. An image forming apparatus, comprising:

the cleaning member according to claim 1; and the image carrier to be cleaned.

4. The cleaning member according to claim 1, wherein the surface modification comprises increasing a hardness of the first material to form the second material.

5. The cleaning member according to claim 1, wherein the surface modification comprises an oxidation treatment.

6. The cleaning member according to claim 1, wherein the surface modification comprises isocyanate resin impregnation.

7. A cleaning member, comprising:

a base member comprised of a first material that has a peak temperature of tan δ less than approximately zero degrees Celsius; and a contact portion comprised of a second material that has a higher hardness than the first material and a tear strength of approximately 49 kilonewtons per meter or higher, the contact portion being configured to contact an image carrier and being configured to clean the image carrier, wherein a surface modification has been performed on a surface of the base member to change the first material into the second material; and wherein the contact portion is formed integrally with the base member rather than being formed through coating.

8. A cleaning member, comprising:

a base member comprised of a first material that has a peak temperature of tan δ less than approximately zero degrees Celsius; and a contact portion comprised of a second material that has a higher hardness than the first material and a tear strength of approximately 49 kilonewtons per meter or higher, the contact portion being configured to contact an image carrier and being configured to clean the image carrier, wherein a surface modification has been performed on a surface of the base member to change the first material into the second material; and wherein the surface modification comprises increasing a hardness of the first material to form the second material.

* * * * *